US007347793B2

(12) United States Patent
Davis

(10) Patent No.: US 7,347,793 B2
(45) Date of Patent: Mar. 25, 2008

(54) WEIGHT-BALANCED GOLF PUTTER HEAD

(76) Inventor: Larry A. Davis, 11075 Montana Ave., Boise, ID (US) 83713

( * ) Notice: Subject to any disclaimer, the term of this patent is extended or adjusted under 35 U.S.C. 154(b) by 339 days.

(21) Appl. No.: 11/136,294

(22) Filed: May 23, 2005

(65) Prior Publication Data

US 2005/0282656 A1 Dec. 22, 2005

Related U.S. Application Data

(60) Provisional application No. 60/573,211, filed on May 21, 2004.

(51) Int. Cl.
*A63B 53/02* (2006.01)
*A63B 53/04* (2006.01)

(52) U.S. Cl. ..... 473/305; 473/313; 473/340; 473/335

(58) Field of Classification Search ..... 473/324–350, 473/287–291, 313–314, 305–312, 248–256; D21/736–746
See application file for complete search history.

(56) References Cited

U.S. PATENT DOCUMENTS

D163,083 S * 5/1951 Belline ..... D21/745
2,954,231 A * 9/1960 MacIntyre ..... 473/251
2,957,696 A 10/1960 Warpotas
3,042,405 A * 7/1962 Solheim ..... 473/313
3,143,349 A * 8/1964 MacIntyre ..... 473/338
3,319,962 A 5/1967 Summers
3,448,981 A 6/1969 Anweiler
3,459,426 A * 8/1969 Sherwood ..... 473/201
3,486,755 A * 12/1969 Hodge ..... 473/251
3,758,115 A 9/1973 Hoglund
3,841,640 A * 10/1974 Gaulocher ..... 473/249
D234,960 S * 4/1975 Swash ..... D21/739
D234,961 S * 4/1975 Swash ..... D21/745
D234,962 S * 4/1975 Swash ..... D21/739
3,888,484 A 6/1975 Zitko
4,141,556 A 2/1979 Paulin
4,194,739 A * 3/1980 Thompson ..... 473/241

(Continued)

OTHER PUBLICATIONS

One page from http://www.golfreview.com/Putters/Dynacraft/PRD_304337_2942crx.aspx, dated May 23, 2005.

(Continued)

*Primary Examiner*—Sebastiano Passaniti
(74) *Attorney, Agent, or Firm*—Pedersen & Co., PLLC; Ken J. Pedersen; Barbara S. Pedersen

(57) ABSTRACT

A golf putter head is generally triangular, when viewed from the top, with a flat, front face and a trailing, central tail. When viewed from the side, the head has a generally straight front face and a flat or slightly curved or rounded bottom surface. The shaft for the grip is anchored to the head at a generally central position on the top of the head, with the axis of the shaft from the ball contact point on the face of the putter head being about one-half the diameter of a legal U.S. golf ball. The head is formed and/or weighted so that the shaft is on the horizontal center of gravity of the putter head, and the vertical center of gravity is about midway between the top and bottom surfaces of the head.

9 Claims, 10 Drawing Sheets

U.S. PATENT DOCUMENTS

| | | | | | |
|---|---|---|---|---|---|
| 4,390,184 | A | | 6/1983 | Rudell | |
| 4,423,874 | A | | 1/1984 | Stuff, Jr. | |
| 4,592,552 | A | * | 6/1986 | Garber | 473/293 |
| 4,712,798 | A | | 12/1987 | Preato | |
| 4,966,369 | A | | 10/1990 | Griffin | |
| 5,058,895 | A | * | 10/1991 | Igarashi | 473/341 |
| 5,078,398 | A | | 1/1992 | Reed et al. | |
| 5,082,277 | A | | 1/1992 | Gingold | |
| 5,174,573 | A | * | 12/1992 | Desbiolles et al. | 473/249 |
| 5,226,654 | A | | 7/1993 | Solheim | |
| 5,257,807 | A | | 11/1993 | Baumann et al. | |
| 5,290,035 | A | | 3/1994 | Hannon et al. | |
| 5,292,128 | A | | 3/1994 | Solheim | |
| 5,324,031 | A | | 6/1994 | Green | |
| 5,332,223 | A | * | 7/1994 | Johnson | 473/306 |
| 5,344,151 | A | * | 9/1994 | Anderson et al. | 473/337 |
| D365,615 | S | * | 12/1995 | Shimatani | D21/743 |
| 5,482,281 | A | * | 1/1996 | Anderson | 473/313 |
| 5,533,730 | A | * | 7/1996 | Ruvang | 473/251 |
| 5,620,379 | A | | 4/1997 | Borys | |
| 5,643,109 | A | * | 7/1997 | Rose et al. | 473/329 |
| 5,685,784 | A | * | 11/1997 | Butler | 473/340 |
| 5,700,207 | A | | 12/1997 | Guthrie et al. | |
| 5,716,290 | A | | 2/1998 | Baker et al. | |
| 5,795,246 | A | | 8/1998 | Hale | |
| 5,830,078 | A | * | 11/1998 | McMahan | 473/252 |
| 5,857,922 | A | | 1/1999 | Delio | |
| 6,033,319 | A | * | 3/2000 | Farrar | 473/313 |
| 6,083,113 | A | | 7/2000 | Bernhardt | |
| 6,244,974 | B1 | * | 6/2001 | Hanberry, Jr. | 473/242 |
| 6,267,689 | B1 | | 7/2001 | Ambrose | |
| 6,440,006 | B1 | | 8/2002 | Johnson | |
| 6,695,708 | B2 | * | 2/2004 | Fisher | 473/244 |
| 6,716,110 | B1 | * | 4/2004 | Ballow | 473/242 |
| 6,796,911 | B2 | * | 9/2004 | Grace | 473/251 |
| 6,926,616 | B1 | * | 8/2005 | Kusumoto et al. | 473/305 |
| 6,929,564 | B2 | * | 8/2005 | Olsavsky et al. | 473/340 |
| 6,958,019 | B2 | * | 10/2005 | Rohrer | 473/324 |
| D513,048 | S | * | 12/2005 | Garner et al. | D21/743 |
| 7,156,752 | B1 | * | 1/2007 | Bennett | 473/334 |
| 7,175,537 | B2 | * | 2/2007 | Pollman | 473/203 |
| 2003/0232661 | A1 | * | 12/2003 | Greer, Jr. | 473/340 |
| 2004/0009825 | A1 | * | 1/2004 | Hale | 473/251 |
| 2006/0148585 | A1 | * | 7/2006 | Vinton | 473/340 |
| 2007/0049401 | A1 | * | 3/2007 | Tateno et al. | 473/339 |

OTHER PUBLICATIONS

One page from http://www.golfreview.com/Putters/Dynacraft/PRD_304344_2942crx.aspx, dated May 23, 2005.

The Golf Works—2004 Master Clubmaker's Catalog—2nd Edition, pp. 48-49.

Golf Digest magazine, pp. 156-161, Feb. 2005.

* cited by examiner

WEIGHT-BALANCED GOLF PUTTER HEAD

This application claims priority based on, and hereby incorporates by reference, Provisional Application No. 60/573,211, entitled "Weight-balanced golf putter head".

BACKGROUND OF THE INVENTION

1. Field of the Invention

This invention relates generally to the game of golf, and more particularly to a golf putter head and a golf putter club incorporating such head.

2. Related Art

Many golf putters and golf putter heads are known.

For example, U.S. Pat. No. 4,390,184 (Rudell) discloses a golf putter head of substantially squared W-shape, when viewed from the top. Preferably, this putter head includes internal weights in its upper portions so that its vertical center of gravity is at or above the midpoint of a ball to be putted.

Also, U.S. Pat. No. 5,082,277 (Gingold) discloses a lightweight, plastic triangular putter head with a front rectangular portion, when viewed from the top. The rear triangular portion is for weighting the head such that the force produced in swinging the club is in the "sweet spot" thereof. The shaft for this club is joined along the centerline of the putter head.

Dynacraft Golf Products, Inc of Newark, Ohio (USA) offers a "DT Mallet Putter" in its 2004 catalog on page 42. The Dynacraft DT Mallet is advertized with "uniform heel-to-toe balance" from a "center shaft design".

Also, in the same catalog on pages 4 and 5, Dynacraft offers an "Orbital Mallet Putter" designed by Mark Myrhum. Dynacraft's Orbital Mallet is advertized as having the "highest moment of inertia" and "backweighted with two thirds of weight in rear stainless steel ring".

Still, there is a need in the game of golf for an effective putter head which is stable and balanced and easy to use. This invention addresses that need.

SUMMARY OF THE INVENTION

The present invention is a golf putter head and a golf putter club incorporating such head. The putter head is generally triangular, when viewed from the top, with a flat, front face and a trailing, central tail. When viewed from the side, the head has a straight front face, which may be slanted forwards or backwards about 2-5°, and a flat bottom, except for an upwardly curving bottom surface near the back end of the trailing, central tail.

Preferably, the putter head is hollow, with smooth, metal plates being provided on the top and bottom of a metal band which is bent to form the generally symmetric, triangular putter head's side perimeter. The interior of the head is preferably weighted with a weighting material, such as steel shot and epoxy, to provide a putting head in the 500-600 gram range. The weighting material is preferably provided in an amount and position so as to place the center of gravity of the head on the centerline of gravity of the portion of the putter shaft anchored to the head, and approximately midway between the top surface and bottom surface of the head.

Regarding the shaft for the grip, the distance of its centerline on the top of the putter head from the ball contact point on the face of the putter head is preferably about 0.840 inches (one-half the diameter of a legal U.S. golf ball). Also, preferably the centerline of the shaft for the grip is on the vertical plane of the horizontal center-line and also on the vertical line for the center of gravity for the putter head. Also, preferably the putter head is about 0.840 inches (one-half the diameter of a legal U.S. golf ball) thick from top surface to bottom surface, about 3-4 inches wide and about 3-4 inches long.

This way, the putter head is easily swung in pendulum-like fashion, or in a generally horizontal putting fashion, without a tendency to twist in motion, for softly and effectively striking the ball during the putt.

DETAILED DESCRIPTION OF THE INVENTION

Referring to the Figures, there is depicted one, but not the only, embodiment of the present invention.

Figure 2:
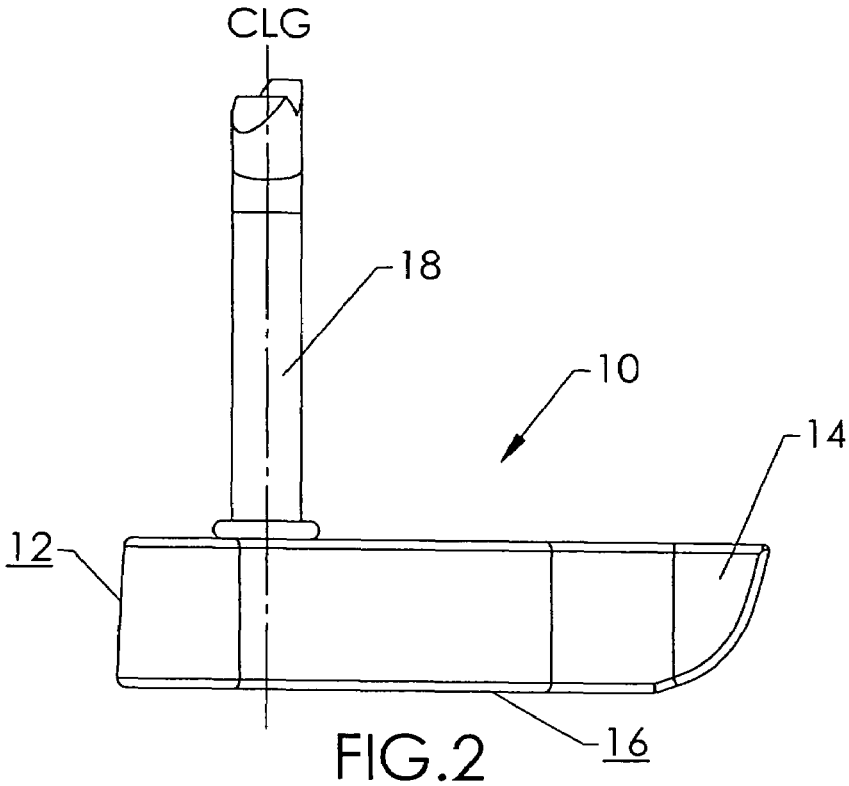
FIG. 2 is a partial, detail side view of the embodiment depicted in FIG. 1, showing to best advantage the putter head.

Golf putter head 10 has a generally symmetric, triangular shape, with no protrusions or extrusions other than the trailing, central trail 14, when viewed from the top. Putter head 10 has a substantially flat, front face surface 12 and a trailing, central tail 14. Front face 12 may be exactly vertical, or may be slanted slightly, for example, slanted slightly forward for achieving top spin when striking the golf ball, or slanted slightly backward, for achieving back spin when striking the ball. Typically, the angle of forward or backward slant may be about 2-5°. However, other, more radically slanted faces 12 are contemplated, for example, as much as 10-15°. The front face 12 depicted in FIG. 2 is slanted backward from bottom to top about 3°. Putter head 10 has a substantially flat bottom surface 16. This way, the head 10 lies flat on the green. Near the back end of trailing, central tail 14, however, the bottom surface curves upwardly, providing room at the back of head 10 to permit easy rotation of the head up through the putting swing without bumping the green.

The gravity centerline of shaft 18, where the shaft connects to putter head, is on the vertical plane of the horizontal centerline, as illustrated by the dashed lines "CL" in FIG.

Figure 5A:
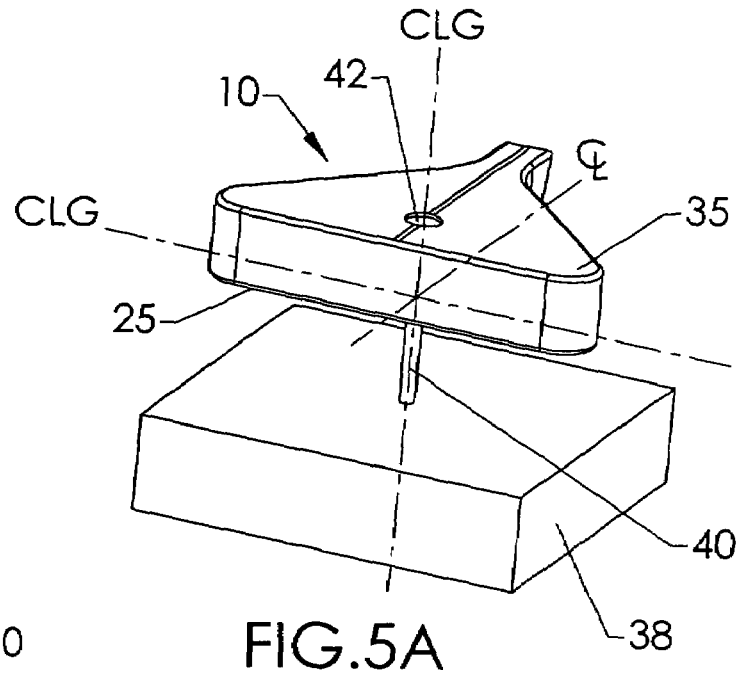
FIGS. 5A-F are schematic, detail views of a test jig in use during manufacture of one embodiment of the invention to ensure that the preferred weight balancing of the golf putter head is achieved.
Figure 5B:
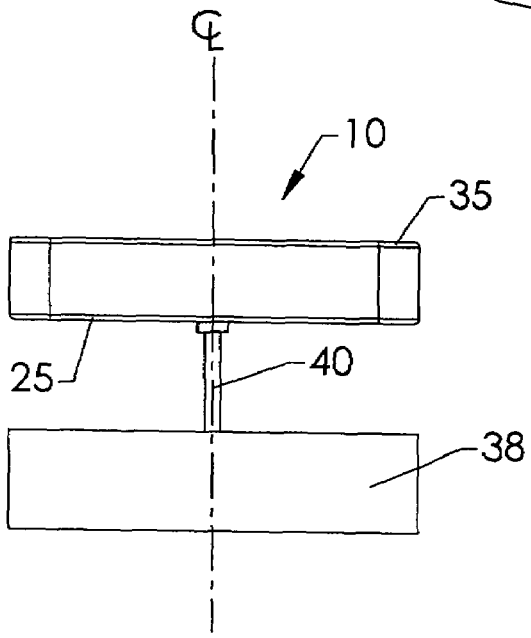
Figure 5C:
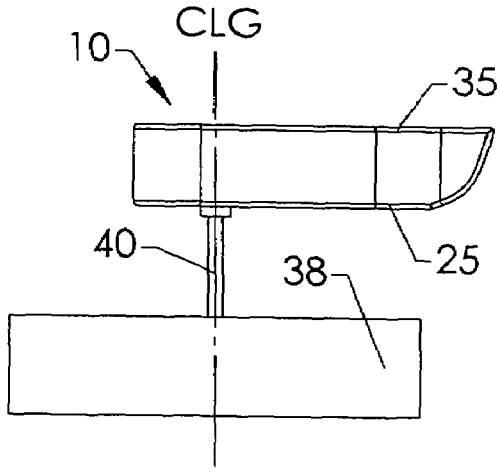
Figure 5D:
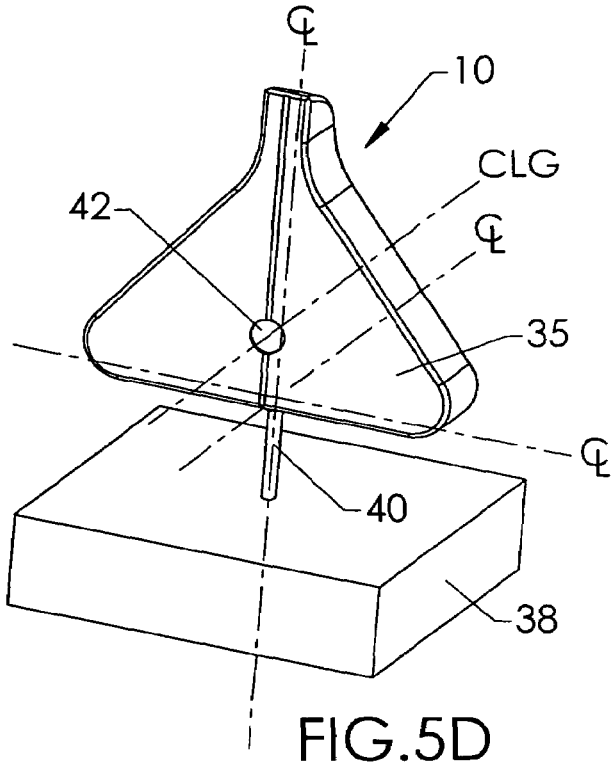
Figure 5E:
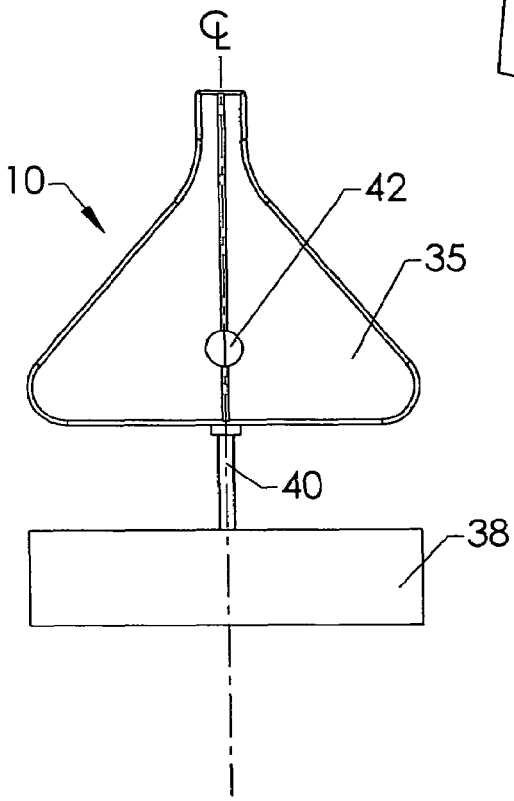
Figure 5F:
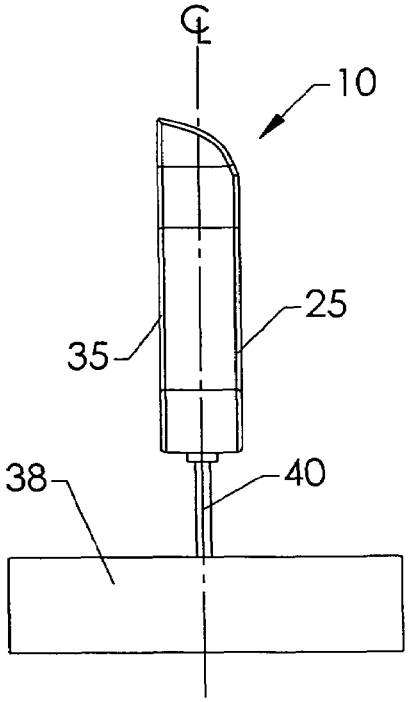

1A, 1B, 4G. The gravity centerline of shaft 18, where the shaft connects to putter head, is also on (co-linear with) the vertical line passing through the center of gravity for putter head 10, as illustrated by the dashed lines "CLG" in FIGS. 2, 3, Test Jig FIGS. 5A, 5C & 5D.

Preferably, the distance of the centerline of shaft 18 to the ball contact point on front face surface 12 is 0.840 inches (one-half the diameter of a legal U.S. golf ball)—or alternatively in the range of 0.74-0.94 inches, or, less preferably, in the range of 0.64-1.04 inches, for example. Preferably, shaft 18 is a standard, single-bend shaft approximately 35 inches long, and is cylindrical in the region where it anchors to the head. However, a standard, double-bend or "stepped" shaft will also work. Preferably, the height of front face surface 12, which is generally the thickness of putter head 10, is also about 0.840 inches (one-half the diameter of a legal U.S. golf ball), but may be between 0.740 inches and 0.940 inches. With either of the above types of shafts, and/or with others, the shaft portion that is anchored to the putter head is cylindrical and of symmetrical design and material, so that the gravity centerline corresponds to the axial centerline of the cylindrical shaft.

Preferably, the putter head 10 is hollow, with smooth, metal plates being provided on the top and bottom of a metal band which is bent to form the generally triangular putter head's side perimeter. The interior of the head is preferably weighted to provide a putting head in the 500-600 gram range.

Figure 1A:
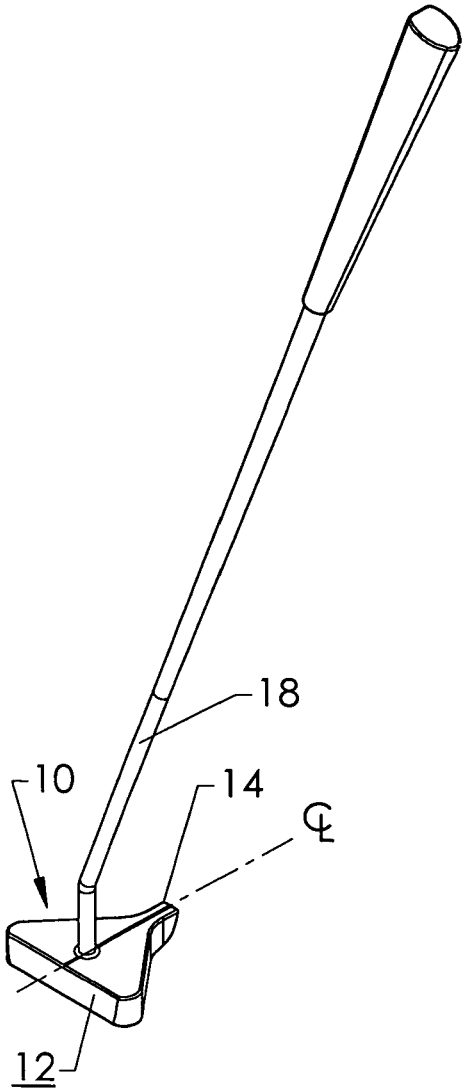
FIG. 1A is a top, perspective view of one embodiment of the golf putter head and golf putter club of the present invention.
Figure 1B:
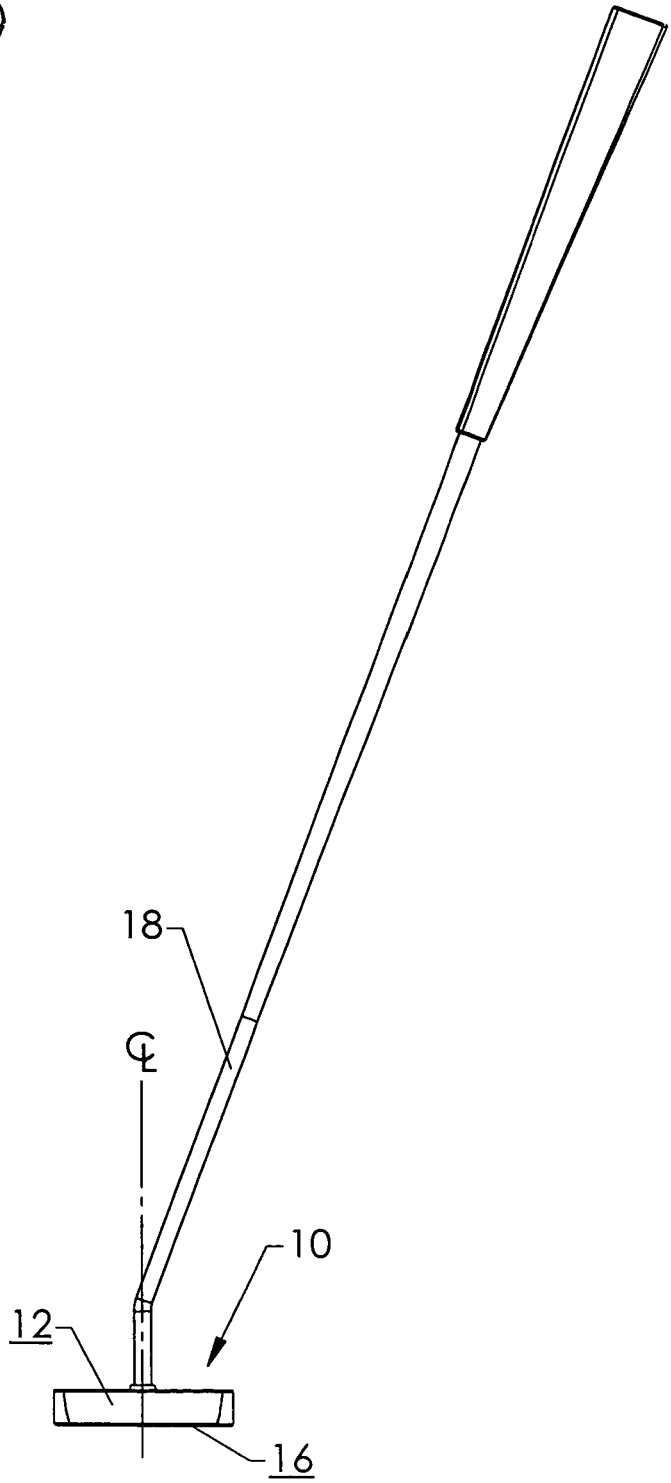
FIG. 1B is a front view of the embodiment depicted in FIG. 1A.
Figure 3:
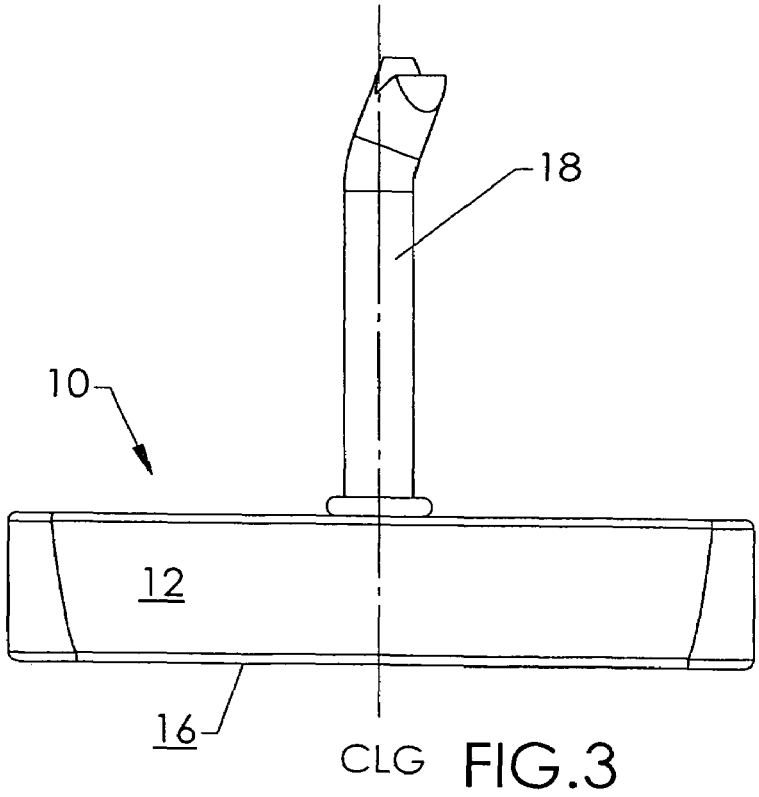
FIG. 3 is a front view of the embodiment depicted in FIG. 2.
Figure 4A:
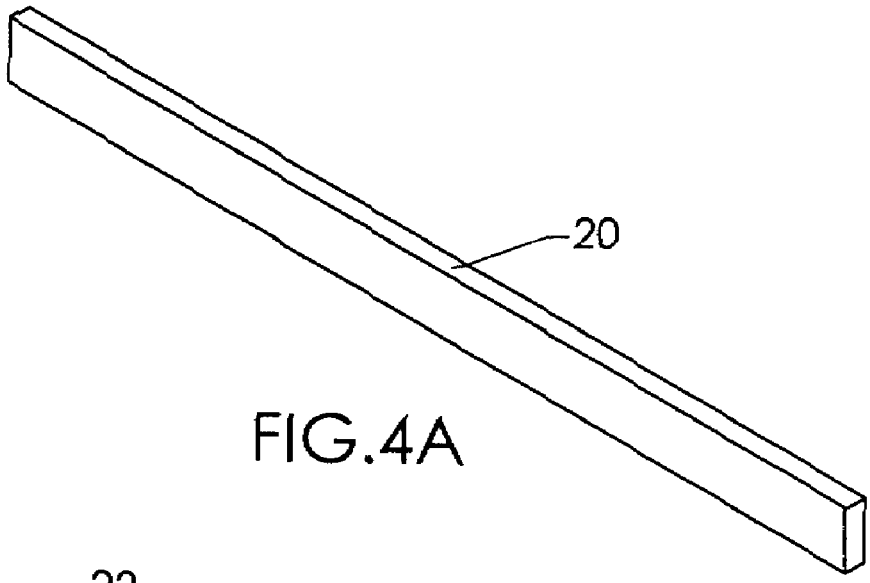
FIGS. 4A-I are schematic, sequential detail views of pieces-parts of the golf putter head of FIGS. 1-3, showing one mode of construction details of the golf putter head.
Figure 4B:
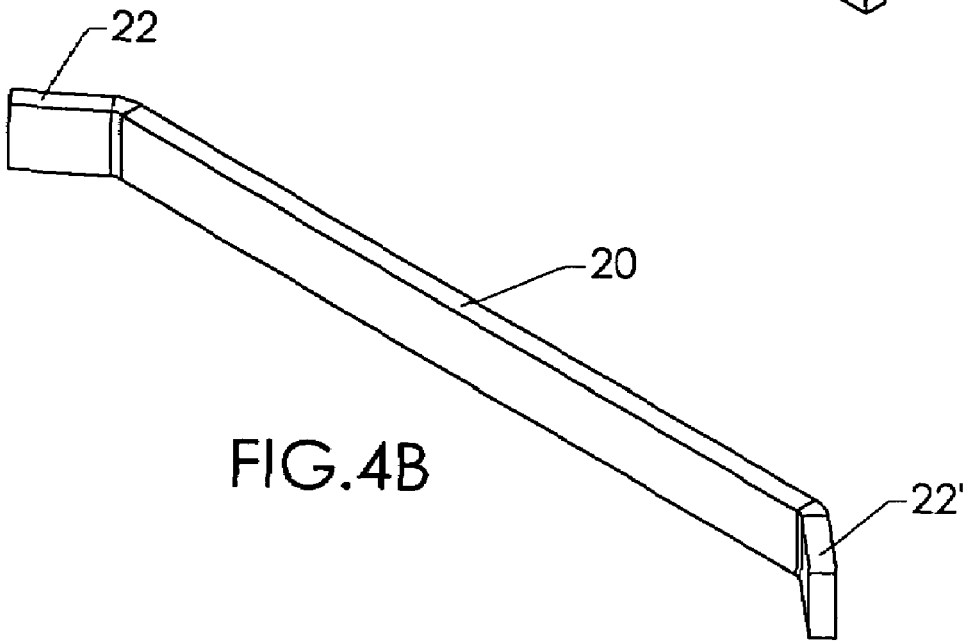
Figure 4C:
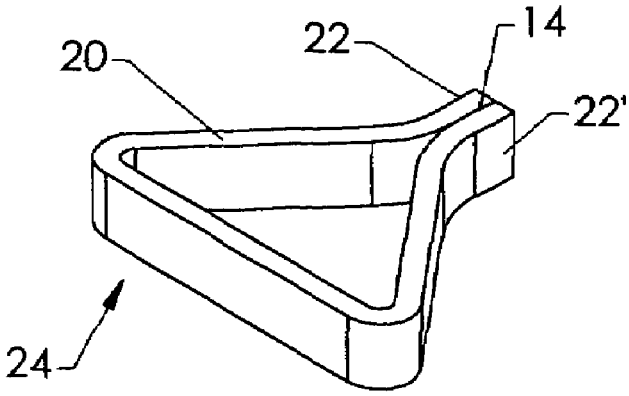
Figure 4D:
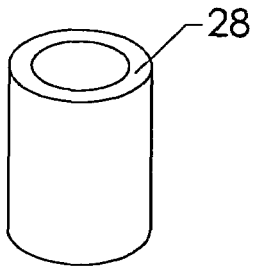
Figure 4E:
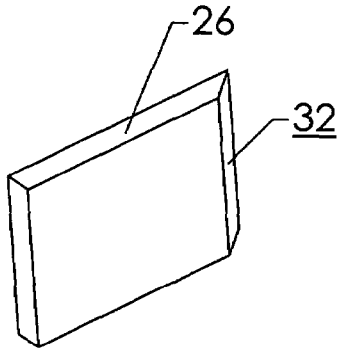
Figure 4F:
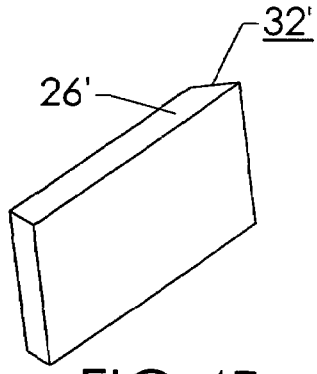
Figure 4G:
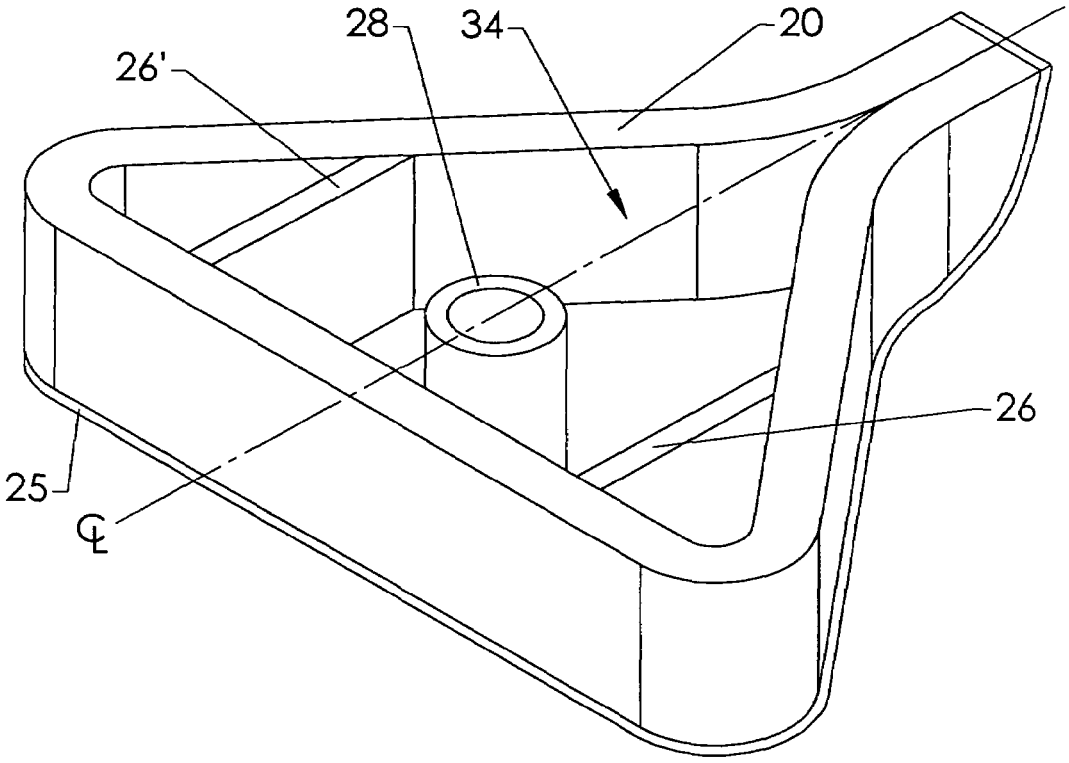
Figure 4H:
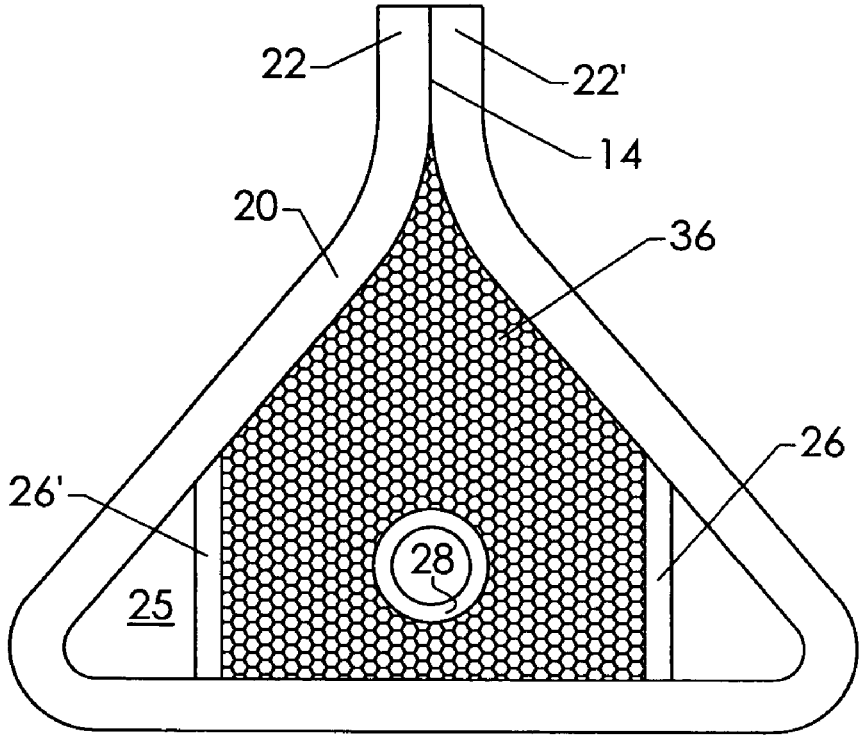
Figure 4I:
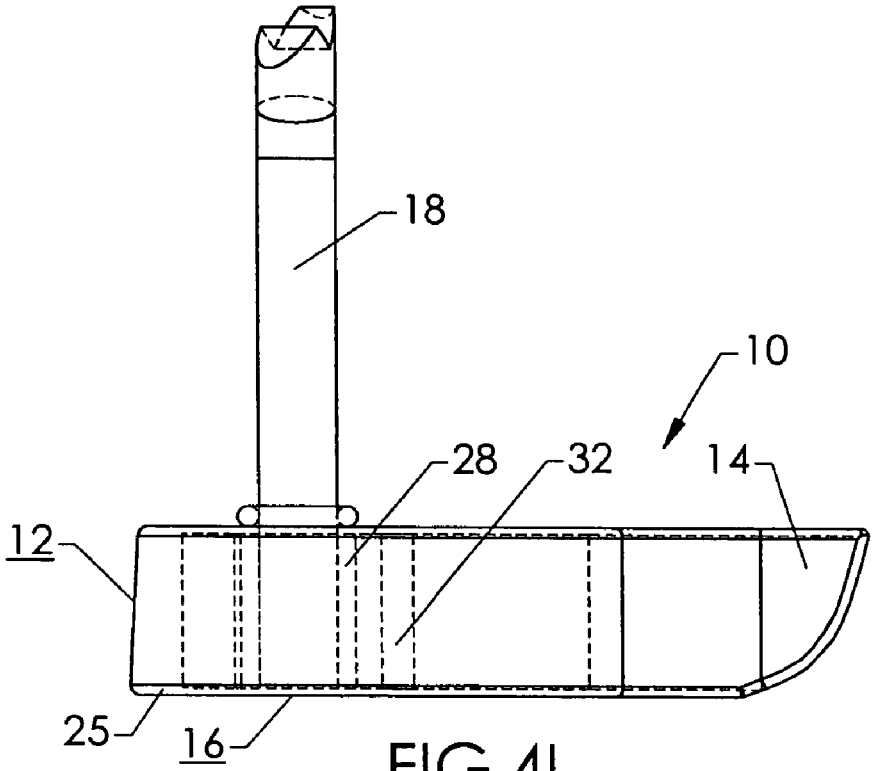

FIGS. 4A-I schematically depict construction of the preferred embodiment of the invention depicted in FIGS. 1-3. First, the shaped, side perimeter of putter head 10 is formed from a 3/16 inch thick, ¾ inch wide, 11 inch long (or between 10 and 12 inches) piece of cold rolled strap steel 20. In a primary bending operation both ends 22 and 22' of the strap 20 are bent down at 135° about 1½ inches in. The strap 20 is turned over, and both ends are bent down in the opposite direction at 160° about 3½ inches in. This secondary bending operation results in a generally triangularly shaped perimeter 24 with the two ends 22 and 22' of the strap joined together and secured to make the trailing central tail 14. The back end of tail 14 may be trimmed then to provide the shape for supporting the upwardly curving bottom surface 16. Alternatively, the ends of the metal strap may be trimmed to this shape before the bending operations.

Next, bottom pan 25 of 20 gauge sheet metal is cut to size and shape, and secured to the bottom edge of shaped perimeter 24 to provide bottom surface 16. Then, shaft receiving barrel 28, a ¾ inch long piece of ¼ inch tubing, is secured to the top of pan 25, so that the axial centerline of barrel 28 is about 0.840 inches from the top of front face surface 12. Then, internal struts 26 and 26', are placed and secured within the shaped perimeter 24. Preferably, struts 26 and 26' are 3/16 inch thick, ¾ inch wide and about 1 inch long steel straps, and mirror images of one another, with a flat, front face and a slanted rear face 32, 32', respectively, to engage closely with the inside front and rear side walls, respectively, of the shaped perimeter 24. This way, an interior, central compartment 34 is created within shaped perimeter 24.

Next, central compartment 34 is at least partially filled with #9 steel shot 36 and epoxy, preferably Durabond™ #454B brand, high-strength, high-temperature resistant epoxy. The steel shot 36 and epoxy glue are added carefully in increments to obtain a total head weight of about 520 grams, which total head weight may be custom-specified by the golfer.

To ensure that nearly perfect weight balance of head 10 about the receiving barrel 28 is maintained as a result of the manufacturing process, a test jig has been developed. As depicted in FIGS. 5A-F, the test jig is a flat block of wood 38 about ½" thick and about 4" square, with a 10-penny nail 40 driven partly into the top of the block near its center. As central component 34 is filled incrementally with steel shot 36 and epoxy, top pan 35 of 20 gauge sheet metal is cut to size and shape like bottom pan 25, and temporarily secured to the top edge of shaped perimeter 24. Top pan 35 has an aperture 42 which corresponds to the top of receiving barrel 28 for receiving shaft 18. Then, the bottom surface 16 of head 10 is marked to indicate a spot corresponding to the bottom of receiving barrel 28. Also, the front face surface 12 is marked to indicate its geometric center. Occasionally during the manufacturing process, when additional shot 36 and epoxy have been added into central compartment 34, top pan 35 is secured, and the weight balance of the head 10 is checked, both in the horizontal (FIGS. 5A-C) direction, and in the vertical (FIGS. 5D-F) direction. The "horizontal test" is done by placing the putter head on the nail head with the nail shaft axis co-linear with the central axis of the receiving barrel 28 (FIGS. 5A, B, and C), and observing whether the putter head balances perfectly without tipping, tilting, or falling off the nail. The "vertical test" is done by placing the putter head on the nail head with the nail shaft axis on the point corresponding to the front surface geometric center (FIGS. 5D, E, and F) and observing whether the putter head balances perfectly without tipping, tilting, or falling off the nail. This way, when head 10 reaches its desired weight (preferably between about 500-600 grams) its nearly perfect weight balance has been maintained. This way, the center of gravity of the head is at the intersection of the gravity centerline of the shaft portion that is anchored to the head and the geometric centerline of the front face surface of the putting head as it extends into the head perpendicularly to the front face if the front face is exactly vertical; if the front face is slanted, then the geometric centerline would extend backward from the geometric centerline of the front face surface in a direction parallel to the bottom surface 16.

Figure 6A:
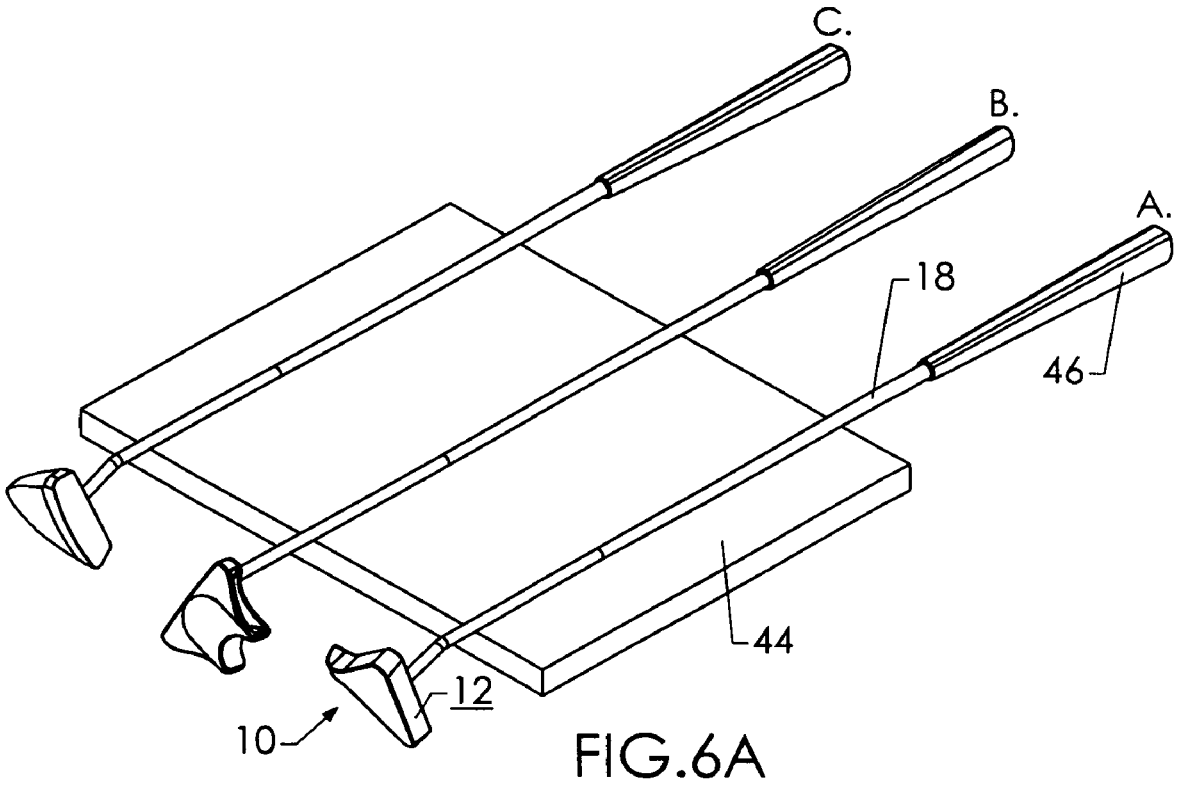
FIG. 6A is a top, perspective view of a test table with an embodiment of the present invention (club "A"), and two clubs of the related art (clubs "B" and "C") on the table.

The effect of weight balance of head 10 is exhibited dramatically in a flat table test of assembled putting clubs as depicted in FIGS. 6A & B. According to the test, the head 10 of the present invention is assembled with standard single-bend, 35" shaft 18. The bend in the shaft is oriented parallel to front face 12. In this putter embodiment, the geometric center axes of all portions of the single-bend shaft (from the head end to the grip end) lie on a single plane parallel to the plane of the front face of the putter head. This is illustrated to best advantage in FIG. 1B, wherein the front face of the putter head and the entire shaft 18 are parallel to each other and to the plane of the paper. In the case of two-bend or stepped shafts, the same parallel arrangement preferably is used, with all portions of the shaft from head to grip having axes that are parallel to the plane of the front face. In the case of front faces that are slanted 2-5°, one may say that all portions of the shafts (whether straight, single-bend, or double-bend) are generally parallel (within six degrees) to the plane of the front face, with the shafts preferably being exactly vertical and so being on a plane 2-5° from the front face plane.

As assembled with a standard Winn™ flat-top grip 46, the preferred putting head 10 and shaft 18 are allowed to come to a balanced, horizontal rest on the flat table-top 44. Preferably, the bend in the shaft is at one front edge of the table, and the handle on the shaft extends past the other, back end of the table as depicted as test item #A in FIG. 6A. The head and shaft assembly of the present invention come to balanced rest with the front face 12 of head 10 perpendicular to the table-top surface, as depicted in test item #A of FIG. 6B.

Figure 6B:
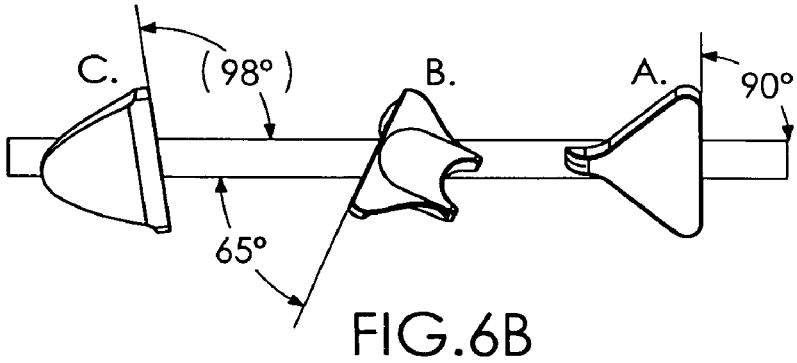
FIG. 6B is an end view of the test table and clubs of FIG. 5A.

On the other hand, when a Knight™ Payroll (PR1)™ head with a straight shaft and an Intech flat-top grip (item #B in FIG. 6A) is allowed to come to rest on the test table-top, the front face of the head rotates around and points backward (to the left in FIG. 6B), up at an angle, as depicted as test item #B in FIG. 6B. Likewise, when a Dynacraft™ DT-Mallet head and True Temper™ single-bend shaft with a Winn™ flat-top grip (item #C in FIG. 6A) is allowed to come to a rest on the test table-top, the front face of the head rotates frontward and points upward, at an angle, as depicted as test item #C in FIG. 6B.

This testing suggests the head and assembled putting club of Applicant's invention is balanced, and exhibits no tendency to twist during the pendulum putting stroke and/or during a generally horizontal "putting stroke." In other words, there will be little or preferably no tendency for the head to twist or rotate on the shaft axis of the shaft during the stroke. The other clubs tested, however, exhibit lack of balance and a natural tendency to twist during the stroke, which tends to change the direction of the put and to change the impact point between the putter face and the ball.

Figure 7A:
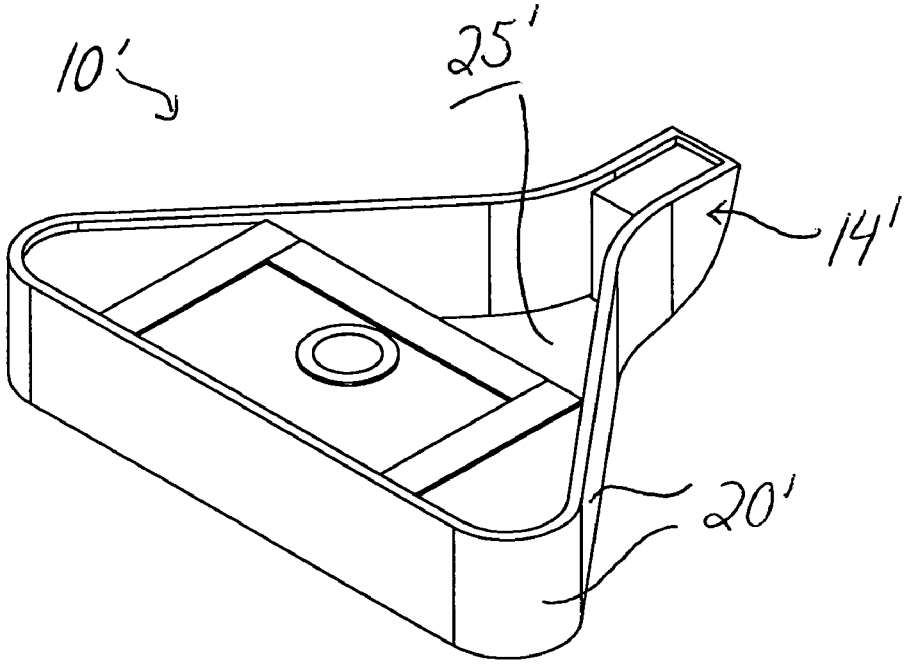
FIGS. 7A and B are illustrations of an alternative method of making a putter head according to the invention.
Figure 7B:
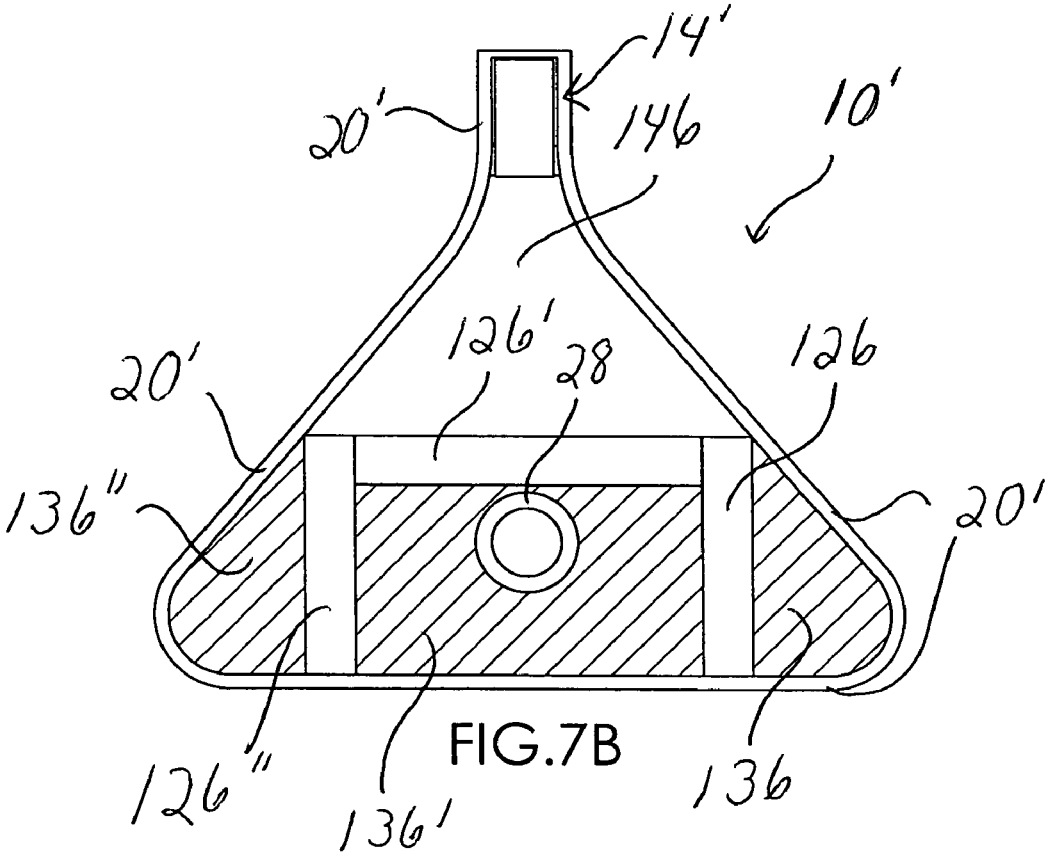

FIGS. 7A and B illustrate an alternative construction and method of balancing the head. The head 10' may be made of a strap 20' and bottom pan 25', in a similar method to FIGS. 4A-4I, but a spacer is placed between the ends of the strap to broaden the tail 14'. Then, internal walls 126, 126', 126" are positioned in the head, and the front regions 136, 136', 136" are filled with weighting material, such as epoxy and metal shot, for example. The rear section 146 will normally remain empty/hollow. Once again, this putter head may be put through a test jig test as above, and/or the table test, as above, during the weighting procedure to preferably ensure that the center of gravity is at the intersection of the shaft axis in the barrel 28 and the centerline extending through the geometric center of the front face and extending parallel to the bottom pan 25'.

Figure 8A:
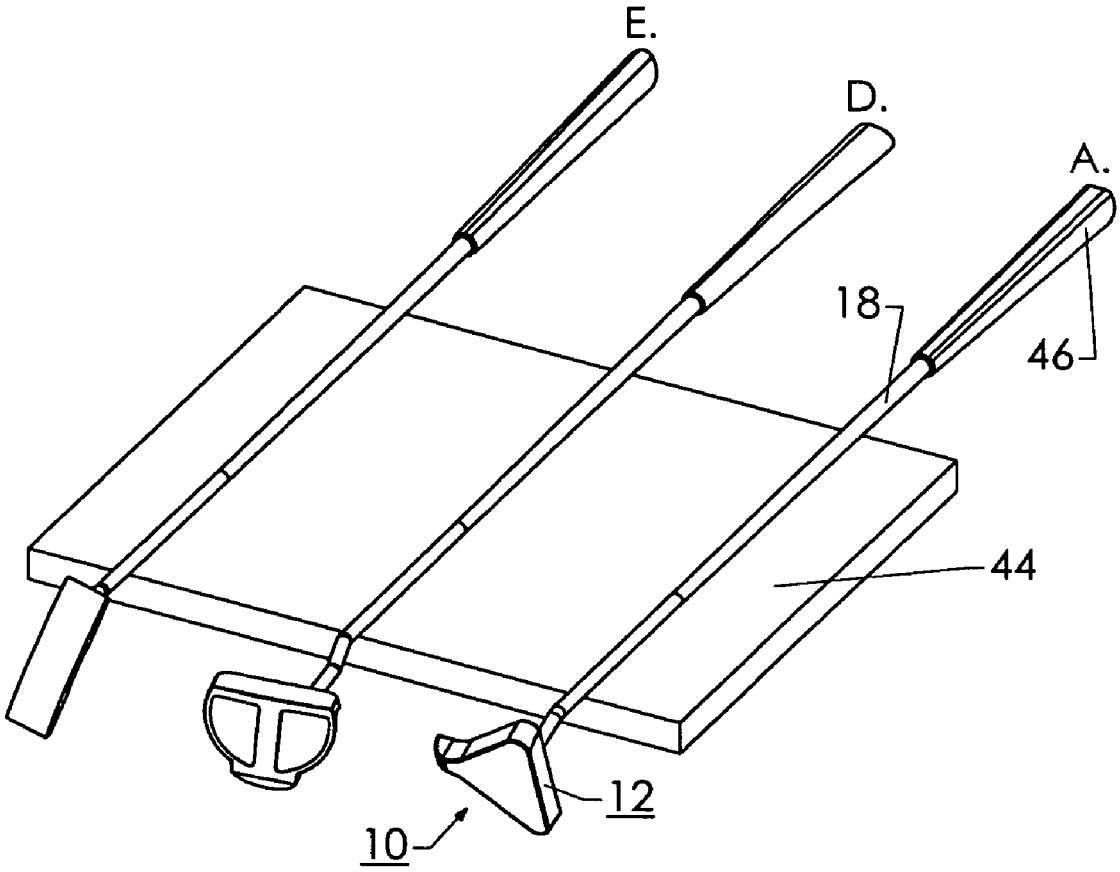
FIGS. 8A and B are illustrations of another table test, comparing an embodiment of the invention to two commercial putters.
Figure 8B:
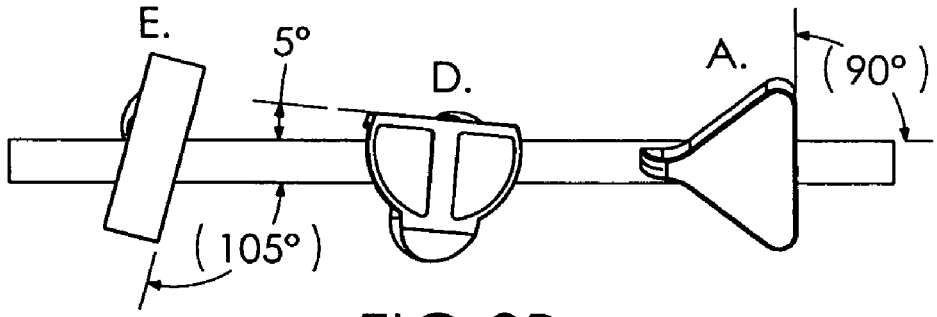

FIGS. 8A and 8B illustrates a table test of an embodiment of the invented putter (item #A in FIGS. 8A and B), compared to two other commercial putters. Item #B is a White Hot Odyssy™ putter, and item #C is a Knight Payroll™ putter. One may understand from this table test, as in the test of FIGS. 6A and 6B, that the head shapes, weighting, and resulting centers of gravity, and/or also the shaft shapes and attachment point on the heads, result in different positions of items #B and #C on the table compared to item #A, with the front face of the putts facing a different directions relative to item #A. This, the inventor believes, corresponds to different swing and impact results when putting with these three putters, and to performance by the invented putter that is unlikely to twist/rotate and/or hit the ball out in a non-optimal position.

While the above-described construction of an embodiment of the invented putter and putter head, and FIGS. 4A-4I, illustrate a substantially manual method of making and balancing the putter head, more automatic and computer-aided methods may be used. For example, an extruded, generally triangular bar may be formed and cut into multiple rough putter heads. Then the outer surface of the rough heads may be polished or otherwise formed or shaped, if desired, and the weight distribution of the head may be set by removing portions of the head, or adding heavier material to the head. For example, cores of metal may be drilled out and the corresponding holes left empty to lighten the head in those locations, or the holes may subsequently be filled with denser materials to add weight in those locations.

Although this invention has been described above with reference to particular means, materials and embodiments, it is to be understood that the invention is not limited to these disclosed particulars, but extends instead to all equivalents within the broad scope of this disclosure, drawings, and exhibit.

I claim:

1. A golf putter comprising:

a head comprising:

a metal band shaped to form a perimeter of the head;

a first piece of sheet metal attached to the metal band to form a bottom pan of the head;

a second piece of sheet metal attached to the metal band to form a top pan, wherein the top pan has an aperture;

wherein a central compartment of the head is between said top pan and said bottom pan, and the central compartment contains a shaft-receiving barrel and is partially filled with metal shot and epoxy; and wherein a shaft extends through said aperture and into said shaft-receiving barrel.

2. The golf puller of claim 1 wherein the aperture encloses a vertical line extending from a center of gravity of the head.

3. The golf puffer of claim 2 wherein the perimeter is generally in the shape of a triangle with a trailing central tail.

4. The golf puffer of claim 3 wherein the shaft comprises a bend and the shaft is in a plane generally parallel to a front surface of the head, the front surface being for striking a ball during puffing with said golf putter.

5. The golf puller of claim 4 wherein the perimeter is between ten and twelve inches.

6. The golf puffer of claim 1, wherein the head comprises a center of gravity midway between a top surface and a bottom surface of the head; and wherein said aperture encloses a vertical line extending from said center of gravity of the head.

7. The golf putter of claim 6, further comprising a front surface of the head for striking a golf ball during puffing with said golf puffer, the front surface generally parallel to said top surface and said bottom surface of the head, and wherein said center of gravity is between 0.74 and 0.94 inches from said front surface of the head.

8. The golf putter of claim 7, wherein the head weighs between 500 and 600 grams.

9. The golf puffer of claim 7 wherein said bottom surface is flat and said front surface is a flat plane within five degrees of a plane perpendicular to said bottom surface of the head.

* * * * *